United States Patent [19]

Georg et al.

[11] 4,063,781

[45] Dec. 20, 1977

[54] APPARATUS FOR LOADING MATERIAL

[75] Inventors: Werner Georg, Lunen; Gerhard Merten, Altlunen, both of Germany

[73] Assignee: Gewerkschaft Eisenhutte Westfalia, Westfalia, Germany

[21] Appl. No.: 662,609

[22] Filed: Mar. 1, 1976

[30] Foreign Application Priority Data

Mar. 6, 1975 Germany ..... 2509803

[51] Int. Cl.[2] ..... E21C 35/20

[52] U.S. Cl. ..... 299/34; 299/43

[58] Field of Search ..... 299/32, 34, 43–45, 299/81; 198/510, 511, 517, 520, 308, 309

[56] References Cited

U.S. PATENT DOCUMENTS

| | | | |
|---|---|---|---|
| 3,361,480 | 1/1968 | Heyer et al. | 299/34 |
| 3,493,267 | 2/1970 | Willner | 299/80 X |
| 3,877,752 | 4/1975 | Hauschopp et al. | 299/34 |

FOREIGN PATENT DOCUMENTS

| | | | |
|---|---|---|---|
| 1,089,353 | 2/1959 | Germany | 198/510 |
| 1,006,767 | 10/1965 | United Kingdom | 299/34 |
| 1,234,756 | 6/1971 | United Kingdom | 299/34 |

*Primary Examiner*—Ernest R. Purser

*Attorney, Agent, or Firm*—Thompson, Birch, Gauthier & Samuels

[57] ABSTRACT

Apparatus for loading material onto a conveyor in a mine working comprises two similar bodies interconnected through a short chain and supported for movement along a guide means at one side of the conveyor. Each body has a shaped base member engaging on the guide means and connected through a plate extending beneath the guide means to a drive chain. This base member has an inclined loading surface extending downwardly towards the floor of the working and in the direction of movement. Additional similarly shaped complementary members can be secured side-by-side with the base members to produce composite loading surfaces of any desired width. Attachments with blades resembling plough shares can be secured to the base members to define a guide surface cooperating with the loading surface to direct material into the conveyor and a number of attachments can be built up one upon another to provide a composite guide surface of any desired height.

18 Claims, 4 Drawing Figures

APPARATUS FOR LOADING MATERIAL

BACKGROUND TO THE INVENTION

The present invention relates to apparatus for loading material onto a conveyor in a mine working.

It is known to utilize scraper-chain conveyors to transport material from a mineral face in a mine working. It is also known to provide a machine or apparatus which moves back and forth along the conveyor to cut and/or load material. One form of known machine is the coal plough which strips coal from a coal face and loads the coal into the conveyor. In other mining techniques, especially for winning valuable ores such as gold, the face bearing the ore is broken up by explosive blasting and the material detached from the face is then loaded into the conveyor. The material to be loaded may vary considerably even in one working or heading and the exact requirements of the loading apparatus are sometimes difficult to forecast. For example, to take extreme cases, a heavy hard irregularly-splintered rock-like material bearing a mineral, which may be in the form of a magmatic gangue, is more difficult to load than relatively light-weight coal and will subject the apparatus to greater wear. It is therefore desirable to be able to make such adjustment of the apparatus to cope with the prevailing conditions and this applies not only when the apparatus is used solely for loading but also where breaking-up or cutting of material is to take place as well.

A general object of the present invention is to provide an improved form of loading apparatus.

SUMMARY OF THE INVENTION

The invention is based upon the concept of adjusting the loading function of the apparatus by providing a loading surface which can be varied in width. Thus in one aspect the invention provides apparatus for loading material onto a conveyor in a mine working; said apparatus being movable in a direction along the conveyor and being of multi-part construction permitting its effective width to be adjusted by the detachment or attachment of complementary parts. The complementary parts may be sheet or plate-like members separable along vertical separation planes extending generally parallel to the direction of movement of the apparatus. This design enables the loading capacity to be varied so that difficult material can be loaded by a narrow surface moved back and forth in several cycles while a less-difficult material can be loaded by a wider surface moved just once or only a few times. The loading surface built up in this way can extend between the conveyor and a mineral face and it is preferable to provide two such adjustable loading surfaces facing in opposite directions. These surfaces may be defined by separate bodies built up from one or more of the complementary parts and interconnected with one another as is known in the coal plough art.

In its basic form the apparatus may have a main base member with a guide surface engageable with an elongate guide means arranged at one side of the conveyor and defining the path of movement of the apparatus, an inclined loading surface extending in the direction of movement of the apparatus and means for facilitating connection with at least one further complementary member which has a similarly inclined loading surface which is disposed in side-by-side relationship with the loading surface of the main member when the members are connected. Preferably a plate or arm extends beneath the guide means and connects the main member with a chain used to drive the member along the guide means. This main member preferably has a flat vertical lateral face which can receive a similar face of the complementary member and these faces may have interengaging projections and recesses to facilitate location and interconnection. Threaded members such as bolts can be used to detachably secure the complementary member to the main member. A particularly useful design provides pocket-like recesses in the loading surface of the main member which receive the heads of bolts and slot-like recesses in the loading surface of the complementary member to receive the shanks of these bolts. A replaceable batten-like insert of wear resistant material is locatable in a recess at the outer face side of the loading surface of each of the members to project beyond the outer face side of the member. When the basic single loading surface is used short bolts secure the insert to the main member and the heads of these bolts locate in the recesses. When a multi-part loading surface is used however the insert is relocated in the outermost complementary member and longer bolts engage in the recesses in the main member and in the slots of the complementary member or members to locate with the insert.

Preferably the main base member has an upper surface provided with means for receiving one or more detachable attachments formed with a blade defining a guide surface for cooperating with the loading surface in guiding material onto the conveyor. A number of attachments, having a size commensurate with the overall width of the loading surface, can be stacked one on another to provide a guide surface of whatever overall height is desired.

Where the material to be handled is particularly abrasive it is appropriate to make certain zones of the apparatus from a wear-resistant material. Thus, in addition to the batten-like insert, detachable cutters or blades can be provided to define the surfaces in contact with the material. It is particularly useful to provide a cutter which forms a combination of the loading surface of each main member and complementary member and which can engage on the floor of the mine working during use.

In one constructional form an apparatus made in accordance with the invention comprises two separate similar bodies interconnected with one another and movable along a guide means at one side of the conveyor, each body being composed of a main base member shaped to engage on the guide means and to define an inclined loading surface extending in the direction of movement of the body and towards the floor of the working, at least one attachment on the main member which has a plough-share like blade which guides material from the loading surface towards the conveyor as the body is moved, means for connecting the member to a drive chain used to drive the bodies along the guide means and complementary members and attachments respectively securable to the main members of the bodies, the complementary members having loading surfaces similarly inclined to those of the main members and arranged side-by-side with the loading surfaces of the main members when secured thereto to provide an overall loading surface which can be adjusted in width by attachment or detachment of said complementary members and the complementary attachments having blades which can conform with the width of the overall loading surface and which can be stacked one on another to increase the height of the overall guide surface provided by the blades.

The invention may be understood more readily, and various other features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF THE PREFERRED EMBODIMENT

Figure 1:
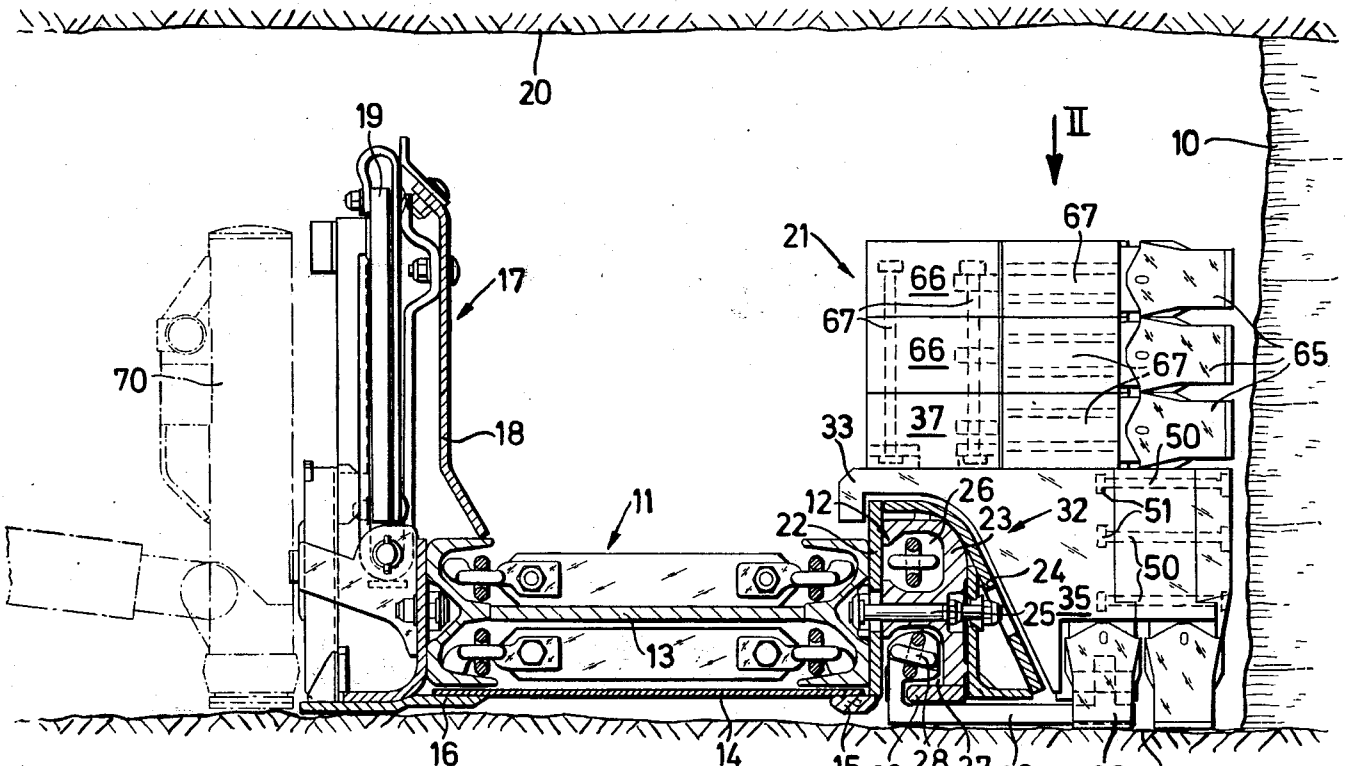
FIG. 1 is a part-sectional schematic end view of a mineral mining installation employing apparatus made in accordance with the invention.

As shown in FIG. 1 a mine installation scraper-chain disposed in a mine working having a roof 20, a floor 34 and a mineral face 10. The face 10, which may be a short heading face, contains mineral in one or more seams or reefs. The installation serves to load and transport material detached from the face 10 and is especially suitable for use with valuable ores such as gold where the stoping, loading and transport of materials should be carried out as far as possible without loss. The material can be detached from the face 10 by explosive blasting and this material can be transported by a scraperchain conveyor denoted 11. The installation employs apparatus described in detail hereinafter which serves to load material into the conveyor 11.

The conveyor 11 is composed in known manner of a series of pans or channel sections joined end-to-end. Where the face 10 is a short heading face the length of the channel sections will be relatively short. Preferably the channel sections are interconnected so as to permit a certain amount of articulation between the channel sections. Each channel section has side walls of sigma-shaped cross-section with a floor plate connected between these side walls. These walls and floor plates define upper and lower passages within which a scraper-chain assembly is moved. The scraper-chain assembly is entrained around drums or sprockets and is driven to circulate within the passages. The material entering the conveyor is then transported by the scrapers moving along the floor 13 constituted by the floor plates of the channel sections. The scraper-chain assembly may be of the type as illustrated having chains moving alongside the side walls and scrapers connected at intervals between the chains or of the type having one or more central chains running along the centre of the conveyor. The lower passage, within which is disposed the return run of the scraper-chain assembly, is closed off with the aid of bottom plates 14 to prevent loss of material. These plates 14 are supported by inwardly projecting strips 15, 16 of L-shaped components fixed to the outer surfaces of the conveyor channel section side walls. The components at the goaf-side, i.e., the side remote from the face 10, support an adjustable screen 17. This screen 17 is capable of being set to close off the space between the goaf side of the conveyor and the roof 20 or swung laterally outwards to permit access. The screen 17 has walls 19 held between springs so as to be raisable and lowerable to any height and walls 18 fixed to the springs. The walls 18 engage on the goaf side wall of the conveyor and overlap with the walls 19. The springs and hence the walls 17, 19 are pivotably supported and clamps or the like serve to maintain the screen 17 in an upright position or permit release of the sections of the screen 17 to enable these sections to be swung laterally downwards. A device, such as a hydraulic ram or plunger shown by the chain-dotted lines 70 can be used to raise or lower the walls 19 as desired.

At the mineral face side of the conveyor there is a guide means for supporting and guiding the loading apparatus of the invention. As shown in FIG. 1, the guide means, generally designated 12, is composed of members detachably secured to the mineral-face side walls of the channel sections through the intermediary of the L-shaped components referred to previously. The guide means 12 and the L-shaped components, designated 22, are secured to the side walls of the channel sections with the aid of bolts 25. The guide means 12 has external plates 24 providing inclined horizontal guide surfaces for the apparatus. Within these plates 24 are inserts 23 which define upper and lower passages 26, 27 for a drive chain 28. This chain 28 is circulated within the passages 26, 27 to propel the apparatus along the guide means. As also shown in FIG. 1, the apparatus itself, which is designated 21, has one or more guide beams or arms 29 which project beneath the guide means 12. These arms 29 extend into the lower passage 27 to connect with the chain 28 therein. Preferably the arms 29 have guide blocks which run within the passage 27. These guide blocks and the connecting end portions of the arms 29 extend in hook-like manner around webs 30 at the bottom of the inserts 23 which partly close off the passage 27 in respect to the floor. The apparatus 21 also has one or more hook-like elements 33 which project over the horizontal guide surfaces of the guide means 12 and engage over the plates 22.

The chain 28 is entrained around sprockets at the end of the conveyor or at the ends of the face 10, if appropriate, and one or both sprockets can be driven to thereby displace the apparatus 21 along the guide means 12. The apparatus 21 is intended to reciprocate back and forth along the guide means 12 and across the face 10. To prevent the chain 28 from becoming jammed in the gap between the webs 30 and the plates 22 it is desirable to offset the sprockets of the chain 28 towards the face 10 in relation to the passages 26, 27 so that if necessary the chain 28 tends to contact the laterally outermost inner surfaces of the passages 26, 27.

Figure 2:
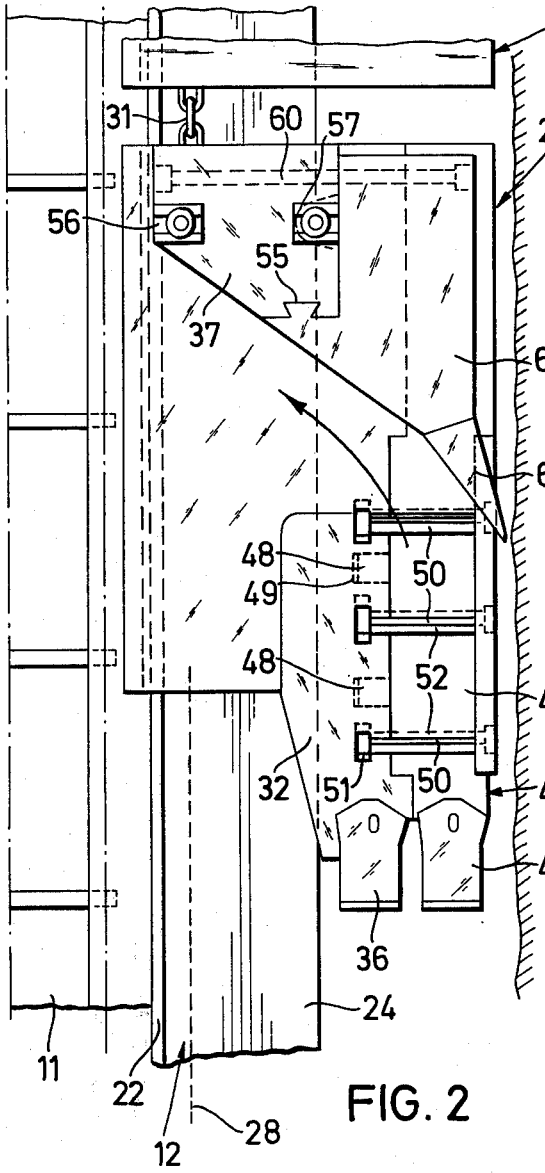
FIG. 2 is a plan view of part of the apparatus as viewed in the direction of arrow II in FIG. 1.
Figure 3:
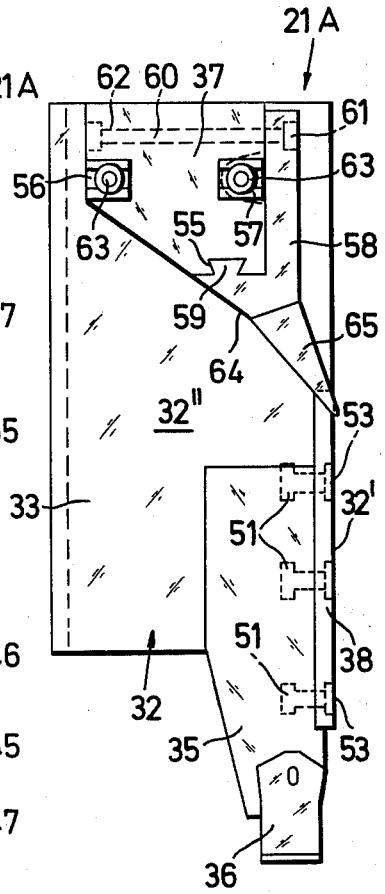
FIG. 3 is a plan view of a modified version of the apparatus represented in FIG. 2.
Figure 4:
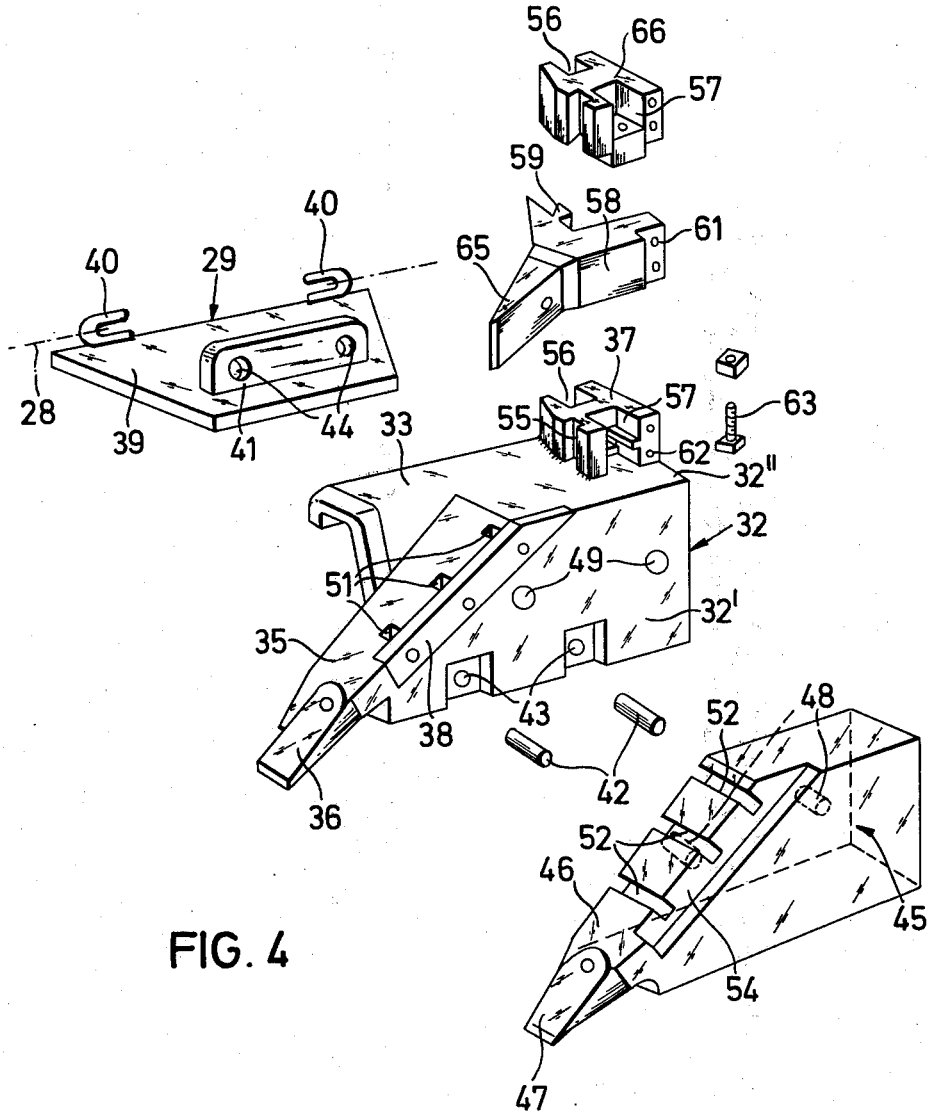
FIG. 4 is an exploded perspective view of certain components of the apparatus.

Referring now to FIGS. 1 to 4, the loading apparatus 21 is constructed overall in a similar manner to a coal plough and has two separate bodies 21A, 21B, connected through a short length of chain 31. The bodies 21A, 21B are symmetrical about a vertical central plane extending across the conveyor and through the chain 31. Only one of the bodies namely 21A is shown in full in FIGS. 2 and 3 and it is to be understood that the other body 21B is constructed in the same manner. Each body 21A, 21B is of multi-part construction and can be adjusted in respect to its overall width and hence its effective loading width. FIGS. 2 and 3 represent such adjustment. The parts permitting such adjustment are detachable along vertical planes extending parallel to the conveyor. The construction of the bodies 21A, 21B will now be described in more detail. As shown in FIG. 4, each body 21A, 21B has a main base member 32 which has a shaped under guide surface conforming to that of the guide means 12. A lateral projection of the member 32 forms the hook-like element 33 referred to previously and the overall height of the member 32 matches that of the guide means 12. A loading surface 35 is provided which inclines downwardly towards the floor. A detachable wear-resistant cutter 36 is fixed to the lower end of the portion defining the surface 35. The overall member 32 preferably extends below the lower surface of the guide means 12 by a distance approximating to the width of the portion defining the surface 35. The member 32 has a vertical side face 32' which faces the mineral face 10 and a top horizontal face 32" extends perpendicularly to the face 32'. An attachment device or support bracket 37 capable of carrying additional attachments is arranged on the top face 32" of the member 32 and can be welded thereto. A replaceable insert in the form of a batten or strip 38 is fixed in a recess at the outer edge of the surface 35. This strip or batten 38 is preferably made of a wear-resistant material and protrudes slightly beyond the face 32' so as to protect the latter from wear. As mentioned previously the apparatus 21 has arms 29 which connect with the drive chain 28. As shown in FIG. 4, a separately fabricated plate 39 constitutes this arm 29. The plate 39 has hooks or brackets 40 attached as by welding alongside its inner side edge and these hooks 40 receive links of the chain 28. A vertical web 41 is also attached to the plate 39 as by welding. This web 41 is received by a slot (not shown) in the member 32 and bolts or pins 42 extend through aligned bores 44, 43 in the web 41 and the member 32 respectively. The bolts or pins 42 are protected within pockets in the face 32' of the member 32. The plate 39 can thus be detachable from the member 32.

In order to increase the width of the bodies 21A, 21B, to thereby increase the loading width, additional complementary members 45 can be secured to the side faces 32' of the members 32 after removal of the battens 38. As also shown in FIG. 4, each member 45 has a loading surface 46 with an inclination commensurate with that of the surface 35 of the main member 32. A detachable wear-resistant cutter 47 is likewise fixed to the lower end portion defining the surface 46. The member 45 has a vertical inner side face which can be secured to the face 32' of the member 32 so that the loading surfaces 46 combine. The location of the members 32,45 is effected by pins 48 fixed to project from the vertical inner face of the member 45 and locating in bores 49 in the face 32' of the member 32. As shown in FIG. 2 the inner side face of the member 45 is stepped at the edge of the loading surface 46 so as to locate in the recess of the member 32 which received the batten 38. The batten 38 removed from the member 32 can be replaced in a corresponding recess 54 in the member 45.

Nuts and bolts are used to secure the batten 38 and the members 32, 45. The loading surface 35 of the member 32 has apertures 51 therein at its recessed edge which receive the heads of the bolts denoted 50 in FIG. 2. The loading surface 46 of the member 45 has slots 52 which receive the shanks of the bolts 50. As shown in FIG. 3 when the single member 32 is used the heads of bolts locate in the apertures 51 and the bolts project through bores in the batten 38. Recesses 53 in the outer face of the batten 38 locate the nuts engaging with the bolt. As shown in FIG. 2, when the additional member 45 is used the batten 38 is relocated in the recess 54 of the latter and somewhat longer bolts 50 are employed with their heads again locating in the apertures 51 and their shanks extending through the slots 52. The nuts for the bolts 50 again locate in the recesses 53 of the batten 38. By providing bores in the member 45 — similar to the bores 49—, or otherwise one or more further members can be secured in a similar manner to the member 45 to build up any desired width of loading surface on each body 21A, 21B.

The bracket 37 attached to the top surface of the member 32 has a slot 55 of T-shaped or dovetail shape facing the surface 35 and additional slots 56,57 in its inner and outer sides, the purpose of which is described hereinafter. Where the member 32 is employed alone, i.e., without one or more additional members 45, an attachment 58 can be attached to the bracket 37 by engaging a key 59 thereof in the slot 55. As shown in FIG. 3, the attachment 58 is secured to the bracket 37 with the aid of bolts 60 engaged through aligned bores 61, 62 in these components. The heads of the bolts and their associated nuts can located within sockets in the bracket 37 and the attachment 58. The attachment 58 has a plough-share like loading blade 65 which seats vertically in relation to the top face 32" of the member 32. This blade 65 has a loading or guide surface 64 which co-operates with the surfaces 32" and 35 in collecting and directing material into the conveyor as the body 21A, 21B is moved. The blade 65 is preferably detachably secured to the main body of the attachment 58 and made from a wear-resistant material.

In order to increase the loading height of the bodies 21A, 21B one or more separate attachment devices or support brackets 66 (FIG. 4) can be secured to the bracket 37. These devices 37, 66 are all similar in shape and bolts 63 (FIG. 3) can locate in their recesses 56, 57 to effect their interconnection. The separate device 66 or each such device can, similarly to the bracket 37, support an attachment 58 connected thereto with bolts 60. Several devices 66 can be installed one upon another in this fashion so that a tower of superimposed attachments 58 with blades 65 of whatever height is desired can be constructed. Where the loading width has been increased by the use of the member 45 the attachment(s) secured to the devices or brackets 37, 66 would need to be of correspondingly larger size. FIG. 2 shows the use of an attachment, here denoted 67, where is scaled-up version of the attachment 58 represented in FIG. 3. The general construction and operation of this attachment 67 is the same as that of the attachment 58.

FIG. 1 represents the use of a body 21A, 21B with members 32, 45 wherein three attachments 67 are mounted one on another with the aid of the devices 66, 37.

The construction of the loading apparatus as described provides great flexibility enabling a wide variation of operating requirements to be coped with.

The overall installation is particularly useful in the mining of valuable ores such as in a gold mining stope where the face 10 is broken up by drilling and blasting. In such an operation, the screen 17 can be collapsed by swinging it laterally outwards to allow ready access to the face 10. Holes are then drilled in the face 10 and charged with explosive. When the blasting is ready to commence the screen 17 is brought into an upright position and locked and the walls 19 thereof are extended, e.g., by the device 70 to contact the roof 20. When the explosive charges are detonated the screen 17 can take up any shock waves and any impingement of face material by virtue of its resilient mounting. The screen 17 ensures primarily that no valuable ore is lost however. Material detached from the face 10 during blasting falls into the conveyor and between the conveyor and the face. Material which falls into the conveyor can be transported away for further treatment by circulating the scraper-chain assembly and the other material can be loaded into the conveyor by reciprocating movement of the apparatus 21 back and forth along the conveyor.

We claim:

1. In a loading apparatus for use in loading valuable metallic ore material onto a conveyor in a mine working, the apparatus being supported for movement along guide means at one side of the conveyor; the improvement comprising providing an inclined continuous loading surface which extends in the direction of movement of the apparatus and which serves to guide and load material onto the conveyor as the apparatus is moved, the continuous loading surface being defined by separable parts arranged in a side-by-side relationship so as to enable the width of said loading surface to be altered by changing the number of said parts.

2. Apparatus according to claim 1, and composed of two similar bodies interconnected with one another, each of the bodies being composed of said parts.

3. Apparatus according to claim 1, wherein one of said parts comprises a main base member with a guide surface engageable with an elongate guide means arranged at one side of the conveyor and defining the path of movement of the apparatus, and wherein the other of said parts comprises at least one further complementary member disposed in side-by-side relationship with the main member when the members are connected so as to cooperatively provide said inclined continuous loading surface.

4. Apparatus according to claim 3, wherein the main and complementary members each have a detachable wear-resistant cutter which is arranged to form a lower continuation of the loading surface thereof.

5. Apparatus according to claim 3, wherein a plate constituting a guide arm is adapted to extend beneath the guide means to connect with a chain used to move the apparatus along the guide means and this plate is detachably secured to the main member.

6. Apparatus according to claim 5, wherein the guide arm is detachably secured to the main member by interengaging connection means composed of complementary male and female members and by removable locking means for holding the male member within the female member.

7. Apparatus according to claim 6, wherein the female member is a slot formed in the main member and the male member is a complementary projection fixed to the guide arm.

8. Apparatus according to claim 6, wherein the locking means is constituted by pins passing through holes in the male and female members.

9. Apparatus according to claim 1, wherein the separable parts extend substantially at right-angles to the direction of movement of the apparatus along the guide means.

10. Apparatus according to claim 1, wherein the parts can be separated along substantially vertical separation planes extending generally parallel to the direction of movement of the apparatus.

11. Apparatus according to claim 10, wherein means is provided to detachably secure the main and complementary members together.

12. Apparatus according to claim 11, wherein the securing means comprises threaded members locatable in recesses in the loading surfaces.

13. Apparatus according to claim 10, wherein there is provided a detachable wear resistant insert mountable in a recess formed alongside the loading surface of the main member and the complementary member, said insert protruding laterally outwards from the member relative to the guide means and being securable to the member with the aid of threaded members locatable in recesses in the loading surface.

14. Apparatus according to claim 10, wherein the main base member has an upper surface provided with means for receiving at least one detachable attachment formed with a blade defining a guide surface for cooperating with the continuous loading surface in guiding material onto the conveyor.

15. Apparatus according to claim 14, wherein there are provided a plurality of such attachments which can be mounted one upon another to increase the height of the combined surfaces cooperating with the continuous loading surface.

16. Apparatus according to claim 15, wherein there are provided attachments with blades of different size which provide surfaces which are commensurate with the width of loading surface used.

17. Loading apparatus for loading valuable metallic ore material into a scraper-chain conveyor in a mine working; said apparatus comprising two separate similar bodies interconnected with one another and movable along a guide means at one side of the conveyor, each body being composed of a main base member shaped to engage on the guide means and to define an inclined loading surface extending in the direction of movement of the body and towards the floor of the working, at least one attachment on the main member which has a plough-share like blade which guides material from the loading surface towards the conveyor as the body is moved, means for connecting the member to a drive chain used to drive the bodies along the guide means and complementary members and attachments respectively securable to the main members of the bodies, the complementary members having loading surfaces similarly inclined to those of the main members and arranged side-by-side with the loading surfaces of the main members when secured thereto to provide an overall continuous loading surface which can be adjusted in width by attachment or detachment of said complementary members, and the complementary attachments having blades which can conform with the width of the overall loading surface and which can be stacked one on another to increase the height of the overall guide surface provided by the blades.

18. Loading apparatus for loading valuable metallic ore material onto a conveyor in a mine working, the apparatus being supported for movement along guide means at one side of the conveyor, the apparatus comprising a main member which defines a continuous loading surface, a guide arm detachably secured to the main member and engageable with the guide means of the conveyor, and complementary attachments securable to the main member, wherein the main member is constituted by a number of separable parts, the said parts being separable along substantially vertical separation planes extending generally parallel to the direction of motion of the apparatus, whereby the width of the continuous loading surface can be varied by the addition or removal of one or more of said parts, wherein the guide arm is detachably secured to the main member by interengaging connection means composed of complementary male and female members and by removable locking means for holding the male member within the female member, and wherein the complementary attachments have blades which conform to the width of the loading surface and which can be stacked one on another to increase the height of the guiding surface provided by the blades.

* * * * *